US006917001B2

(12) United States Patent
Muroi et al.

(10) Patent No.: US 6,917,001 B2
(45) Date of Patent: Jul. 12, 2005

(54) TIME SWITCH

(75) Inventors: Hiroaki Muroi, Kitaku Osaka (JP); Takayuki Todokoro, Agatuma-gun (JP); Kazuo Yanagida, Agatuma-gun (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/899,132

(22) Filed: Jul. 27, 2004

(65) Prior Publication Data

US 2005/0051410 A1 Mar. 10, 2005

(30) Foreign Application Priority Data

Jul. 28, 2003 (JP) ..... 2003-281235
Aug. 26, 2003 (JP) ..... 2003-301914

(51) Int. Cl.[7] ..... H01H 43/00

(52) U.S. Cl. ..... 200/38 D; 200/35 R; 200/38 R; 200/38 A; 200/38 F; 200/38 B

(58) Field of Search ..... 200/33 R–40

(56) References Cited

U.S. PATENT DOCUMENTS 3,555,214 A * 1/1971 Lee et al. ..... 200/38 DA
3,925,629 A * 12/1975 Albinger, Jr. ..... 200/38 R
4,827,460 A * 5/1989 Mahon et al. ..... 200/38 R X
5,811,746 A * 9/1998 Noritake ..... 200/38 R
6,262,497 B1 * 7/2001 Muroi et al. ..... 307/139
6,838,628 B2 * 1/2005 Amonett et al. ..... 200/38 R X

FOREIGN PATENT DOCUMENTS

JP 63-29427 2/1988

* cited by examiner

*Primary Examiner*—James R. Scott
(74) *Attorney, Agent, or Firm*—Greenblum & Bernstein, P.L.C.

(57) ABSTRACT

A time switch that provides a convenient time setting method through a sub-dial that can be rotated clockwise or counter-clockwise. A gearwheel set, through which motor torque is conveyed to a dial, includes a ninth drive gear and a ninth shank gear which is joined to a step shaft on which the ninth drive gear rotates. A circular depression is formed within the rear side of the ninth drive gear, the inner perimeter on which are formed multiple ratchet teeth at uniform intervals. Ratchet pawls, which extend from the shank portion of the ninth shank gear, engage the ratchet teeth to form a ratchet mechanism that does not slip when the torque applied by the motor is sufficient to rotatably drive the dial, but that slips when the torque applied to the ratchet mechanism from the dial is greater than that applied by the motor.

11 Claims, 11 Drawing Sheets

TIME SWITCH

BACKGROUND OF THE INVENTION

1. Field of the Invention

The invention relates to a time switch whereby the on and off states of internal contact points control the operation of an electrical load according to a time schedule.

2. Description of the Background Information

A conventional time switch, such as the type described in Japanese Kokai (laid open) Patent S63-29427, includes a modular structure assembled from a motor that rotates at a uniform speed, a ratchet gear driven by a gearwheel transmission powered by the motor, and a first gear that meshes with the ratchet gear. The time switch also includes a sub-dial that rotates clockwise at a rate of one revolution per hour relative to the rotation of the ratchet gear, a gear that meshes with a second gear attached to the rotating shaft of the sub-dial, a dial that rotates clockwise once during a 24-hour period relative to the rotation of the sub-dial, a scheduling clip with a finger that projects from the circumference of a dial used to set a desired operating time schedule, and an internal contact point activating mechanism that opens and closes the contact points through contact with a contact element that is freely settable to a desired time. In the time switch of Japanese Kokai (laid open) Patent S63-29427, the ratchet gear, which is rotatably driven by motor torque supplied through the gearwheel transmission, rotatably drives the sub-dial through the sub-dial shaft. Although the dial is rotationally driven by meshing with the second gear on the sub-dial shaft, the sub-dial shaft rotates only in one direction due to the ratchet mechanism formed by the first gear and ratchet gear at the rotating sub-dial shaft. As a result, even though the sub-dial can be turned manually to set the time, it can only be turned in one direction, thereby making it time-consuming to set the time. For example, when changing the time schedule due to the enactment of daylight savings time, it would be easy to turn the sub-dial back one hour from a current setting of 7 o'clock to a 6 o'clock setting. Because the sub-dial can only be turned in the clockwise direction, however, it must be advanced 23 hours to effect the desired time change. As a result, changing the time becomes a time-consuming operation.

SUMMARY OF THE INVENTION

In order to rectify the shortcomings of the prior art, the invention provides a time switch in which the time can be more conveniently set by turning the sub-dial in either a clockwise or counter clockwise direction.

An aspect of the present invention provides a time switch including a switch case, a dial rotatably attached to the face of the switch case, the dial rotatably driven at a uniform speed through a gearwheel transmission powered by a motor rotating at a uniform speed; scheduling clips including finger portions which project from the perimeter of the dial to determine a desired operating time; a cam shaft supported by the switch case; first cams projecting from the perimeter of a scheduling cam rotatably supported by the cam shaft, the scheduling cam rotatable through contact with respective finger portions of the scheduling clips, second cams projecting from the perimeter of a switching cam rotatably supported by the cam shaft, the switching cam rotatable in one direction together with the scheduling cam; contact points that switch between on and off positions relating to the rotation of the second cams provided on the switching cam; and a ratchet mechanism provided within the gearwheel mechanism that does not slip when torque transmitted from the motor is sufficient to rotatably drive the dial, and slips when the dial is manually turned while being rotatably driven by torque transmitted from the motor.

A further aspect of the present invention includes a manually rotatable sub-dial provided within the gearwheel transmission; wherein the ratchet mechanism is provided between the motor and the sub-dial. Further, the time switch may include a mechanism provided to generate greater resistance to rotation of the dial when the dial is manually turned in a direction counter to the direction in which it is turned by the motor. Further, the ratchet mechanism may include a disc-shaped member and multiple ratchet teeth formed at uniform intervals along the internal perimeter of a circular depression formed within one side of the disc-shaped member; a drive gear that rotates in response to rotation of the motor; a flexible ratchet pawl and a tip portion on the flexible ratchet pawl held in mesh with the ratchet teeth; and a shank gear that conveys torque from the drive gear to the dial; wherein the shank gear is rotatably driven by the drive gear, through the ratchet mechanism, by torque transmitted from the motor when the dial is rotatably driven by the motor, the torque being insufficient to disengage the ratchet mechanism, and wherein the shank gear disconnects from the drive gear due to the manual rotation of the dial conveying torque sufficient to flex the ratchet pawls to the extent of riding over the ratchet teeth.

A further aspect of the present invention provides a mechanism provided to generate a feeling of greater resistance when the dial is manually turned in a direction opposite to the motor-driven direction as compared to the feeling when the dial is manually turned in the motor-driven direction, the mechanism including a ratchet pawl tip symmetrically formed on both sides of the approximate radial intersection line at the inner perimeter of the circular depression; and triangular ratchet teeth having edges intersecting right and left sides of the radial intersecting line at different angles. The present invention may further include a clutch mechanism, the clutch mechanism including first clutch teeth formed on the side of the scheduling cam opposing the switching cam; second clutch teeth formed on the switching cam, the second clutch teeth meshing with the first clutch teeth; and a pressure applying device to apply pressure to the scheduling cam against the switching cam; wherein the first and second clutch teeth mutually engage to transfer torque from the scheduling cam to the switching cam when the dial is rotatably driven in the motor-driven direction, and wherein the first and second clutch teeth mutually disengage to prevent the transfer of torque from the scheduling cam to the switching cam when the dial is turned in a direction opposite to the motor-driven direction.

Further, wherein the number of the first and second clutch teeth includes as a whole integer multiple of the number of the first cams of the scheduling cam. Additionally, the pressure applying device may include a coil spring; the scheduling cam is rotatably supported by a cam shaft provided on the switching cam; the coil spring is positioned over the cam shaft to apply pressure to the scheduling cam against the switching cam; and a locking clip is joined to a groove formed in the cam shaft to support the coil spring between the scheduling cam and the lock ring. The time switch may include a friction reducing member provided between the scheduling cam and the coil spring. The shank gear may be formed integrally and in one piece with a supporting shaft. The cam shaft may be formed integrally and in one piece with the switching cam.

The present invention allows the time to be more conveniently set by manually turning the dial in either the motor-driven direction or the opposite direction thereto. This is made possible by the torque transmitted from the manually turned dial rotating the ratchet mechanism, thus preventing the transmission of torque from the motor to the dial.

Further, the manually rotatable sub-dial is installed within the gearwheel transmission, and the ratchet mechanism is installed between the motor and the sub-dial. This structure, allows the sub-dial to be manually turned in the motor-driven direction or the opposite direction thereto as means of more conveniently setting the time.

The mechanism able to generate greater resistance to the rotation of the dial when the dial is manually turned in a direction opposite to that in which it is turned by the motor and generates a stronger feeling of resistance when the dial is manually turned in a direction opposite to the motor-driven direction as compared to the resistance felt when the dial is manually turned in the motor-driven direction, therefore making it easy to discern, through the differently felt resistances, if the dial should be advanced or turned back.

In the ratchet mechanism, although torque transmitted from the dial will rotate the shank gear of the ratchet mechanism, the tips of the ratchet pawls will ride over the ratchet teeth causing the shank gear to disengage from the drive gear, thus allowing the time to be more conveniently set through the manual rotation of the dial in either the motor-driven direction or the opposite direction thereto.

By including triangular ratchet teeth whose edges intersect the right and left sides of the radial intersection line at different angles, the ratchet teeth may be easily designed to a configuration that generates more resistance when the ratchet pawls ride over the ratchet teeth when the dial is turned in a direction opposite to the motor-driven direction than when the ratchet pawls ride over the ratchet teeth when the dial is turned in the same direction as that driven by the motor. This structure thus makes it easy to establish a stronger feeling of resistance when the dial is turned back to the desired time setting than when advanced to that time setting.

When the dial is turned in a direction opposite to the motor-driven direction, the scheduling cam rotates as a result of the clip finger of the scheduling clip (which projects from the perimeter of the dial) pressing against the first cam. However, the rotation of the scheduling cam is not conveyed to the switching cam because the clutch mechanism mutually disengages the first and second clutch teeth. This mechanism prevents the switching cam from rotating in a direction opposite to the motor-driven direction, and thus prevents the unnecessary operation of the contact points as would otherwise occur if the switching cam were to rotate in a direction opposite to the motor-driven direction.

As a result of the disengagement of the first and second ratchet teeth, only the scheduling cam will rotate when the dial is turned in a direction opposite to the motor-driven direction. However, by establishing the number of first and second clutch teeth as a whole integer multiple of the number of first cams on the scheduling cam, the first clutch teeth on the scheduling cam will engage the second clutch teeth on the switching cam as soon as the scheduling cam completes its rotation. Thus, a mechanism is provided through which the switching cam will be immediately driven by the scheduling cam when the dial rotates in the motor-driven direction.

By rotatably installing the scheduling cam over a cam shaft integrally formed with the switching cam, placing the coil spring over the cam shaft, and attaching the lock clip to the cam shaft, a block-type clutch assembly is formed which can be easily assembled to the switch case.

Because a large amount of friction would be generated between the scheduling cam and coil spring if the coil spring were in direct contact with the rotating scheduling cam, the provision of a friction-reducing member between the scheduling cam and coil spring results in the smooth rotation of the scheduling cam.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe embodiments of the invention with reference to the accompanying drawings. The first embodiment of the present invention will be described with reference to FIGS. 1 through 11 with positional references (top, bottom, right, left) being based on FIG. 3 unless otherwise specified.

Figure 3:
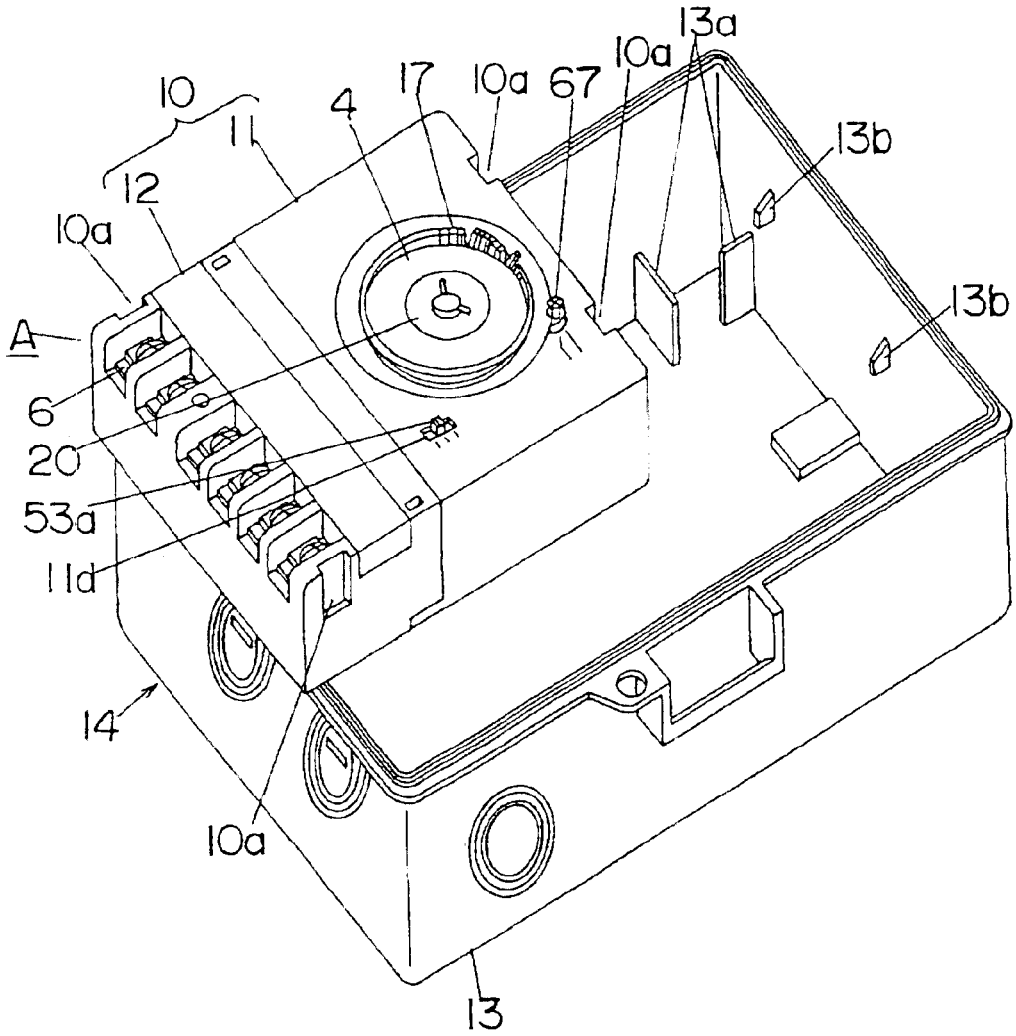
FIG. 3 is a perspective view of the time switch of the embodiment of FIG. 1 with external an case.

As shown in FIG. 3, switch case 10 of time switch 'A' is formed as an assembly of main case 11 and sub-case 12, main case 11 housing mechanical clock mechanism 1, and sub-case 12 housing externally exposed screw-type input-output terminal portion 6 and internally located relay drive circuit 8 (to be described subsequently) that drives relays 7*a* and 7*b*. Switch case 10 of time switch 'A' is housed within outer case 14 which includes box-shaped lower case 13, of which the top portion is open, and an upper case (not shown in the drawing) that covers the open top portion of lower case 13. Switch case 10 is placed on the floor of lower case 13, and is secured in position by multiple projecting ribs 13*a*, notches 10*a* which are formed on at least three sides of switch case 10, tabs 13*b* that extend inward from the sidewalls of lower case 13 into notches 10*a*, and lock fingers (not shown) formed on the floor of lower case 13, the tips of the lock fingers being formed as hook parts that join to notches 10*a*. Switch case 10 is placed over ribs 13*a*, and tabs 13*b* connect to notches 10*a* and the hook parts, thus securely attaching switch case 10 to the floor of lower case 13. Alternatively, switch case 10 may be secured to outer case 14 through the use of any suitable devices such as, for example, screws or other such mounting hardware.

Figure 11:
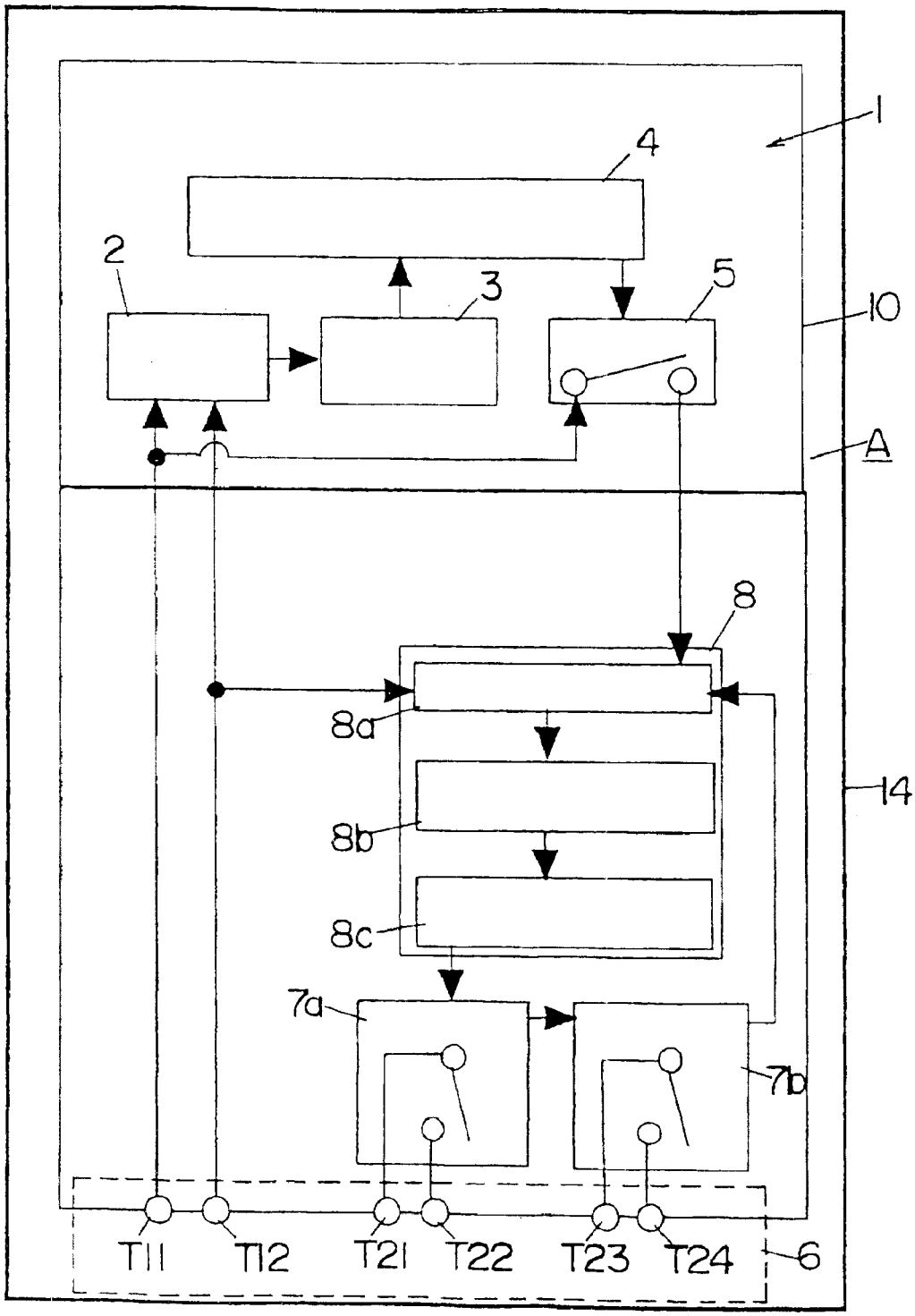
FIG. 11 is a block diagram of the time switch of the embodiment of FIG. 1.

Time switch 'A' is equipped with the electrical circuit shown in FIG. 11. Clock mechanism 1, which is installed in main case 11, is equipped with synchronous motor 2 that rotates at a uniform speed of 600 rpm synchronized with the frequency of commercially supplied electrical power. Alternatively, instead of the synchronous motor 2, the present invention may include any suitable motor such as, for example, a stepping motor controlled by the output of a crystal-driven oscillating circuit.

Gearwheel transmission 3 reduces the speed of synchronous motor 2 at a ratio of 864,000/1 to drive dial 4, which is located at the center of the front surface of main case 11, at a rate of 1/1,440 rpm. In other words, dial 4 rotates once every 24 hours for the 24-hour time switch described in this embodiment. Therefore, setting the desired time schedule through the placement of scheduling clip 17 on dial 4 will result in contact points 5 opening and closing, according to the time schedule, in order to generate operating signals.

Input-output terminal portion 6, which is provided on sub case 12, is equipped with a pair of electric power terminals T11 and T12 that connect to a commercial electricity power source. This embodiment also includes two pairs of load terminals, T21 and T22, and T23 and T24, which are able to control two electrical loads. Load terminals T21 and T22, and load terminals T23 and T24 are controlled by the operation of contact points within load control relays 7*a* and 7*b* respectively, the contact points being opened and closed through the operation of relay drive circuit 8. Relay drive circuit 8 is made up of AC voltage drop circuit 8*a* which acts as a transformer to drop the source voltage, rectification circuit 8*b* which rectifies the output of AC voltage drop circuit 8*a* to output a DC voltage, and relay voltage circuit 8*c* which lowers and smooths the DC voltage from rectification circuit 8*b* so that relays 7*a* and 7*b* receive the required voltage. One input terminal of relay drive circuit 8 is connected to power terminal T11 through contact points 5, and the other input terminal is connected to power terminal T12. Therefore, when contact points 5 go "on" according to the set time schedule, electrical power is supplied to activate relays 7*a* and 7*b*.

Figure 2:
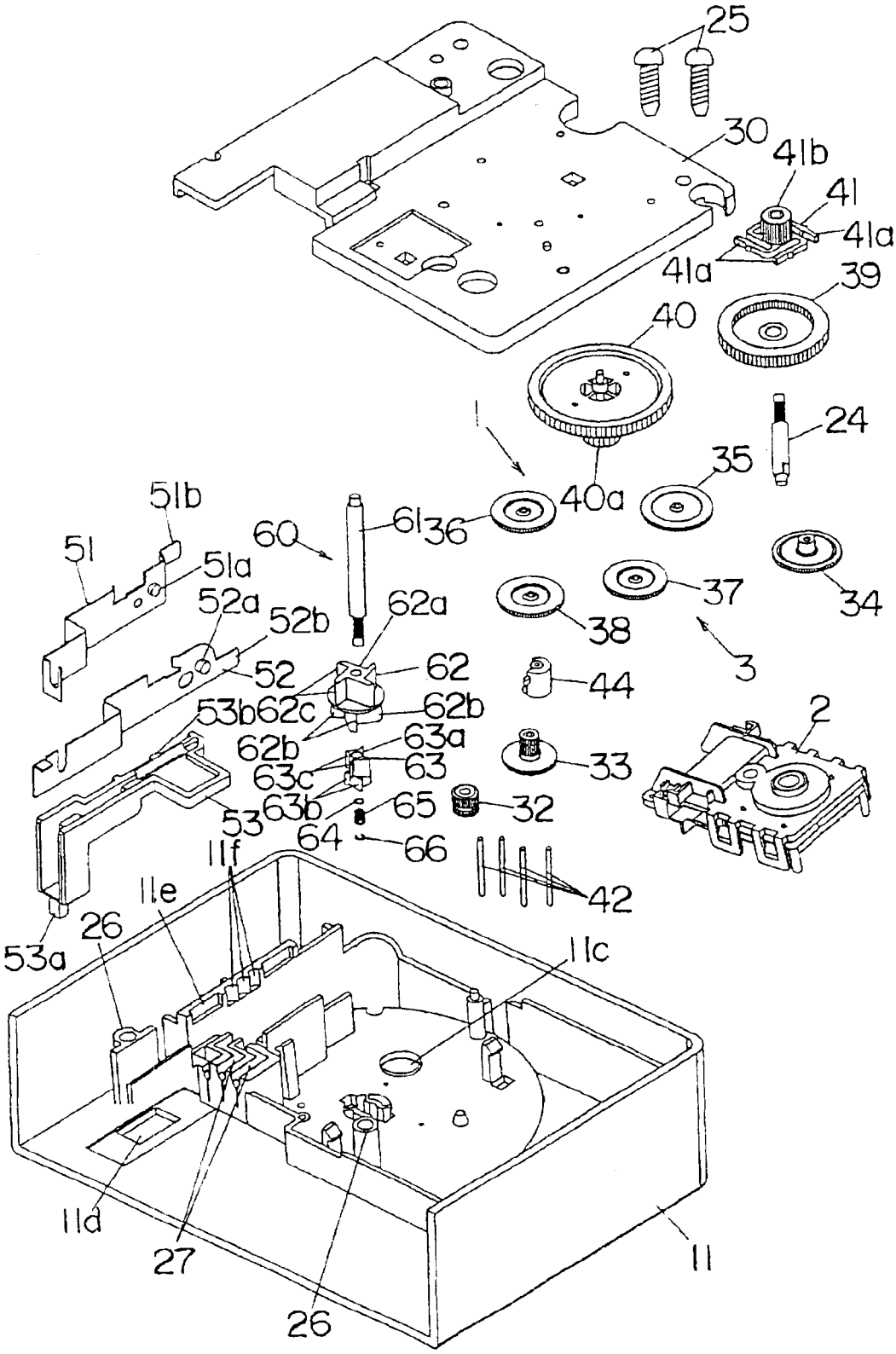
FIG. 2 is an exploded partial perspective view, as seen when viewed from below the clock mechanism, of the time switch of the embodiment of FIG. 1.

The following will describe the structure of clock mechanism 1 with reference to the accompanying drawings. FIG. 2 shows an exploded perspective view of the components including clock mechanism 1 which is installed within main case 11. Clock mechanism 1 is made up of multiple gears 32 through 41, gear shafts 42, spring arms 51 and 52 to which contact points 51*a* and 52*a* are attached, switch bracket 53 which is used to select the operating mode, cam switch assembly 60 which is used to manually connect or separate the contact points and, as will be described subsequently, to connect or separate the contact points according to the time schedule set by scheduling clip 17, the components being installed and aligned in parallel with the front wall of main case 11 between center cover 30 and main case 11. Moreover, while center cover 30 is attached to main case 11 by screws 25 inserted through holes in center cover 30 and into threaded bores provided in bosses 26 located on the rear surface of main case 11, center cover 30 may also be attached to main case 11 through any suitable device such as, for example, interlocking members.

Figure 4:
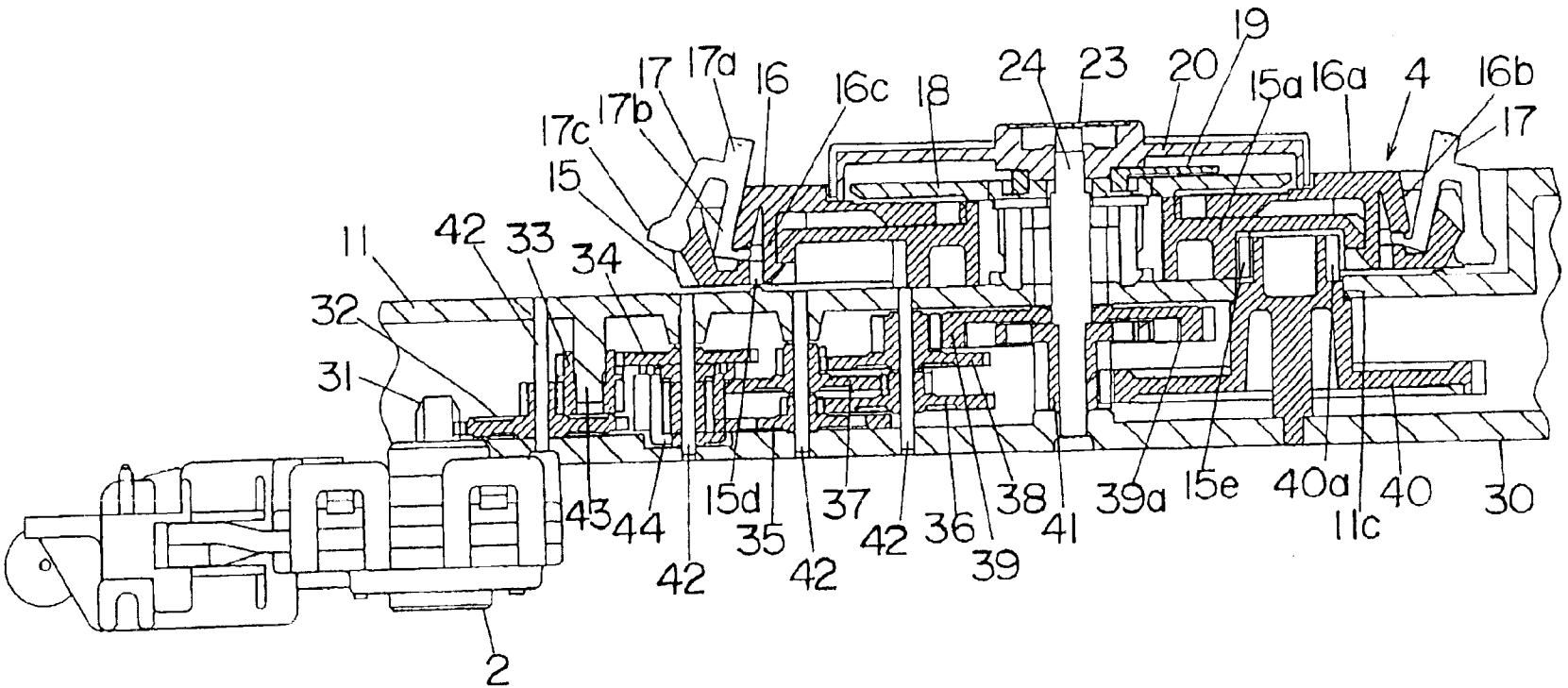
FIG. 4 is a cross sectional view of the gearwheel transmission of the time switch of the embodiment of FIG. 1.
Figure 5:
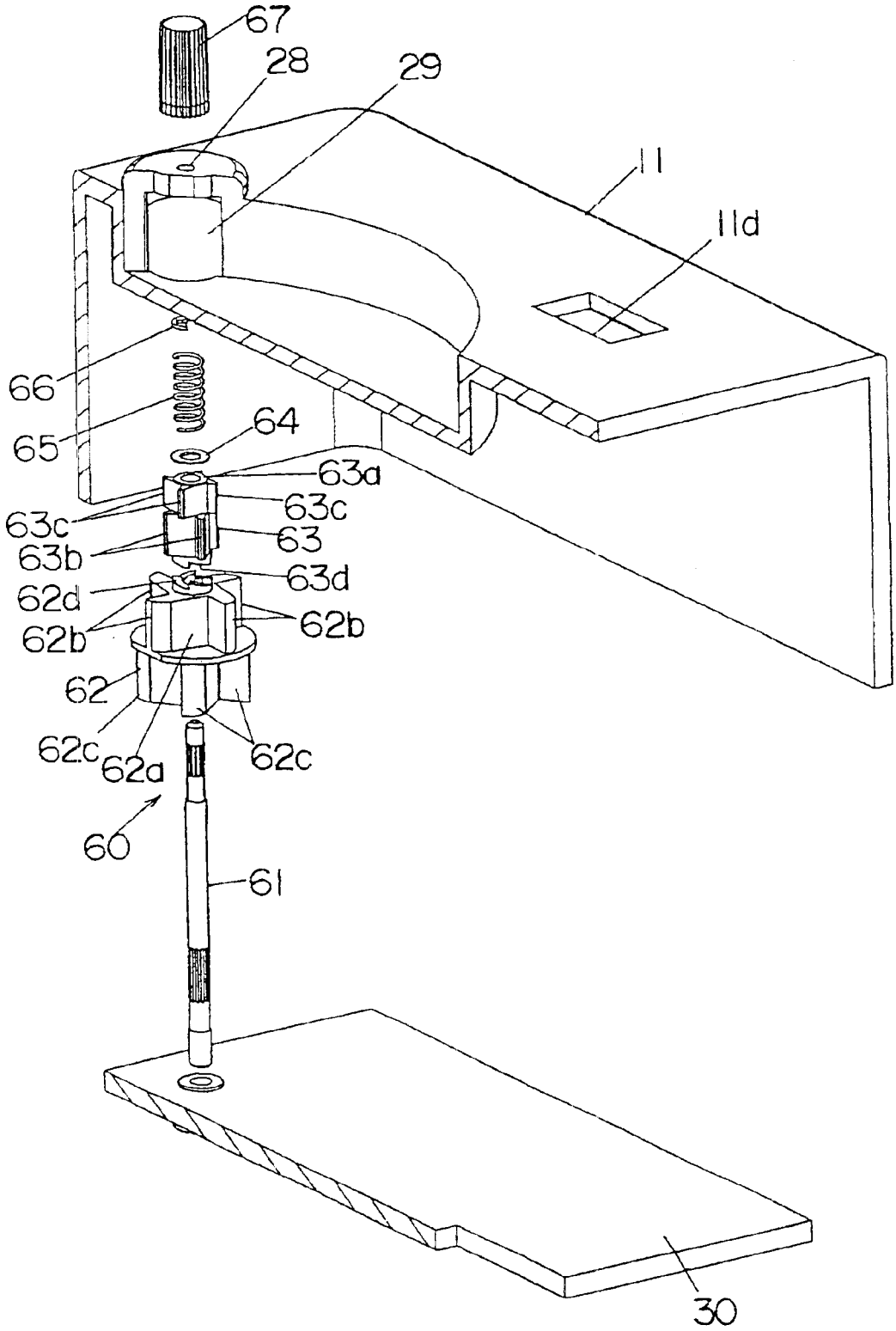
FIG. 5 is an exploded perspective view of the switch cam assembly of the time switch of the embodiment of FIG. 1.

The following will describe gearwheel transmission 3 with reference to FIGS. 2 and 4. Synchronous motor 2, including the output shaft, is installed on the rear surface of center cover 30, and first shank gear 31 meshes with second gear 32 through a hole provided in mid-cover 30. Gears 32 through 38 are rotatably supported on gear shafts 42 located between main case 11 and mid-cover 30, and on gear shaft 43 that extends from the rear surface of main case 11. Ninth drive gear 39 is rotatably supported by step shaft 24. A circular recess is formed within the rear side of ninth drive gear 39, and ratchet teeth 39*a* are formed on the inner circumference of the circular recess in the form of multiple uniformly spaced triangular teeth (see FIG. 8*a*). Moreover, ninth shank gear 41 is fixedly attached to step shaft 24 through interference fitting, gluing, welding, or other desired attachment method so that gear 41 rotates together with step shaft 24 (on which ninth drive gear 39 freely rotates) as a single structure. L-shaped pawls 41*a*, which extend at uniform intervals from the perimeter of the shank part of ninth shank gear 41 in a configuration of angled spokes, mesh with multiple ratchet teeth 39*a*. The flanks of ratchet teeth 39*a* and the tips of pawls 41*a* are formed to approximately the same angle $\alpha$ (e.g. 45 degrees) with respect to line L1 that radially intersects the inner circumference of the recessed part of ninth drive gear 39. A ratchet mechanism is formed by the tips of pawls 41*a* contacting ratchet teeth 39*a* while pinion gear 41*b* of ninth shank gear 41 meshes with mushroom gear 40. Moreover, pawl 41*a* is structured as a finger-like member whose tip part meshes with ratchet teeth 39*a*. Circular recessed part 11*a*, which is formed within the front part of main case 11 in order to house dial 4, incorporates through hole 11*c* in the bottom part into which gear 40*a* of mushroom gear 40 is inserted. Gear 40*a*, which projects to the front side of through hole 11*c* and meshes with gear 15*e* of dial base 15, will be described subsequently.

With gearwheel transmission 3 thus structured, the rotational torque of first shank gear 31, which is attached to and rotatably driven by the output shaft of motor 2, is transferred to ninth drive gear 39 through second gear 32, third gear 33, fourth gear 34, fifth gear 35, sixth gear 36, seventh gear 37, and eighth gear 38. Therefore, ninth drive gear 39 rotates in the same direction as the motor, and because the tooth flanks of ratchet teeth 39*a* of ninth drive gear 39 press against the tips of pawls 41*a* of gear 41, ninth shank gear 41 is rotatably driven in the same direction as ninth drive gear 39, and the rotation of ninth shank gear 41 is transferred to sub-dial 20 through step shaft 24. Also, torque is transferred to dial 4 through mushroom gear 40 which drives sub-dial 20 and dial 4 in a clockwise direction. As synchronous motor 2 rotates at a speed synchronized to the frequency of commercial electric power, gearwheel transmission 3 reduces the speed of the motor to a point where sub-dial 20 rotates once per hour, and dial 4 rotates once in 24 hours. Moreover, rotational restrictor cam 44, which is installed at fourth gear 34, restricts the direction that sub-dial 20 and dial 4 may be rotated by driven motor 2 to only a clockwise direction. Although the rotational direction of fifth gear 35 is restricted, rotational restrictor cam 44 would not be needed if motor 2 were the type that rotates in only one direction.

Figure 1:
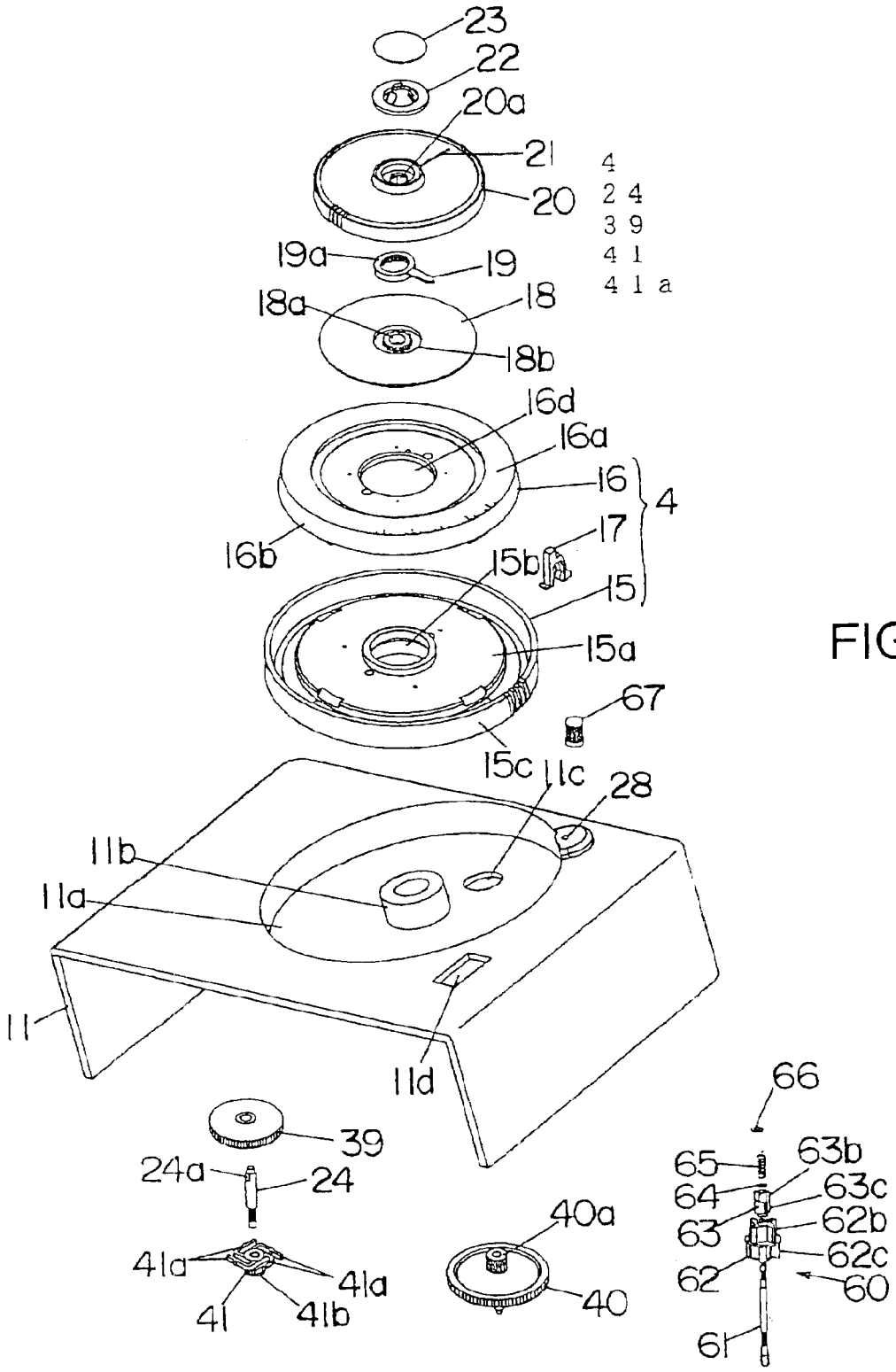
FIG. 1 is an exploded partial perspective view, as seen when viewed from above the clock mechanism, of the time switch of a first embodiment of the present invention.

The following will describe contact points 5 and cam switch assembly 60 with reference to FIGS. 2, 5, 6, and 7. As shown in FIG. 1, spring arms 51 and 52 are rectangular metal members into which an S-shaped portion is bend-formed at the mid-point, and each S-shaped portion is secured within main case 11 by being pressed into channel 27 formed therein. Mutually opposing contact points 51*a* and 52*a* are formed on the free ends of spring arms 51 and 52. Flange 51*b* extends from the lower part of the end of spring arm 51 (the side of spring arm 51 opposite to the front wall of main case 11) as the part of spring arm 51 that contacts lower cams 62*c* of switching cam 62, described below. Flange 52*b* extends from the upper part of the end of spring arm 52 as the part of spring arm 52 that contacts an upper cam 62*b* of switching cam 62.

Switch bracket 53, which may be formed from any suitable material such as, for example, molded from synthetic resin, includes lug 53*a* that is inserted into window orifice 11*d* in main case 11 with switch bracket 53 provided within slide channel 11*e*, thus allowing switch bracket 53 to slide within the limits of window orifice 11*d* to any of three positions located by ridge 53*b* inserted into one of three channels 11*f* formed on main case 11. In other words, lug 53*a* can be switched between three positions. With lug 53*a* placed at the middle "automatic" position, the motor-driven or manual rotation of dial 4 results in the rotation of switching cam 62 of cam switch assembly 60, described below, and the bendable closing or opening of contact points 51*a* and 52*a* on spring arms 51 and 52 (automatic mode). Sliding lug 53*a* to the "off" position, a position where switch bracket 53 is at one end of its traversable limit, results in a projection on switch bracket 53 pushing spring arm 51 away from spring arm 52, thus separating contact points 51*a* and 52*a* (an "off" condition) and rendering them unaffected by the operation of scheduling clip 17 (which projects from the perimeter of dial 4) and cam switch assembly 60. Also, sliding lug 53*a* to the "on" position, the position where switch bracket 53 is at the other end of its traversable limit, results in a projection on switch bracket 53 pushing spring arm 52 toward spring arm 51, thus connecting contact points 51*a* and 52*a* (an "on" condition) and rendering them unaffected by the operation of clip 17 (which projects from the perimeter of dial 4) and cam switch assembly 60. "Off," "Auto," and "On" markings are provided on the front of main case 11 to easily identify the position of lug 53*a*.

Further, cam switch assembly 60 includes cam shaft 61, switching cam 62, scheduling cam 63, thrust washer 64, coil spring 65, E-clip 66, and knob 67. Thrust washer 64 may be any suitable device such as, for example, a commercially known "poly-slider washer". Cam shaft 61 is rotatably supported between main case 11 and mid-cover 30, one end being supported by bearing bore 28 at the perimeter of recessed part 11*a* of main case 11, and the other end being rotatably supported by a bore in mid-cover 30. Open part 29 is formed at the inner perimeter of recess 11*a* at the bearing bore 28 location in order to expose off-cam 63*b* and on-cam 63*c* on scheduling cam 63.

Switching cam 62, which may be formed of any suitable material such as, for example, molded synthetic resin, incorporates cylindrical part 62*a* into which cam shaft 61 is press fit, and four upper cams 62*b* that extend radially from the upper portion of shank 62*a* at uniform intervals. The purpose of upper cams 62*b* is to contact flange 52*b* of spring arm 52. Switching cam 62 also incorporates four lower cams 62*c* that extend radially from the lower portion of shank 62*a* at uniform intervals, the purpose of lower cams 62*c* being to contact flange 51*b* of spring arm 51. Clutch teeth 62*d* are formed on one axial end of shank 62*a* facing the lower side of scheduling cam 63. Upper cams 62*b* and lower cams 62*c* form the second cams which, when viewed axially, display a radial offset of approximately 45 degrees between the upper and lower cams.

Scheduling cam 63, which may be formed of any suitable material such as, for example, molded synthetic resin material, is constructed approximately the same as switching cam 62, and includes cylindrical shank 63*a* into which cam shaft 61 is inserted, and four off-cams 63*b* that extend radially at uniform intervals from the upper perimeter of cylindrical shank 63*a*. The purpose of off-cams 63*b* is to contact clip finger 17*c* of scheduling clip 17 (hereafter referred to only as clip finger 17*c*) when scheduling clip 17 is tipped downward toward dial 4. Scheduling clip 17 contacts four on-cams 63*c* that extend radially at uniform intervals from the perimeter of the lower end of cylindrical shank 63*a* toward switch cam 62, the purpose of on-cams 63*c* being to contact clip finger 17*c* when scheduling clip 17 is tipped upward. Clutch member 63*d*, which engages clutch member 62*d*, is provided at the other end of shank 63*a* (the end facing switch cam 62). Off-cams 63*b* and on-cams 63*c* combine to form the first cam which, when viewed axially, demonstrates a radial offset of approximately 45 degrees between the two cams.

Cam switch assembly 60 is assembled by first press fitting cam shaft 61 into the hole in cylindrical shank 62*a* with clutch member 62*d* facing upward, and then pressing switching cam 62 over the bottom portion of cam shaft 61. Cam shaft 61 is then inserted into the hole in shank 63*a*, with clutch member 63*d* facing downward, thereby resulting in scheduling cam 63 being movable in the axial direction of cam shaft 61. Thrust washer 64 and coil spring 65 are then placed over cam shaft 61 after which E-clip 66 is secured in the groove (not shown in the drawing) on cam shaft 61. In this assembled condition, coil spring 65 presses scheduling cam 63 against switching cam 62 with clutch member 62*d* (of switching cam 62) engaged with clutch member 63*d* (of scheduling cam 63). Moreover, scheduling cam 63 is not able to move freely in the axial direction on cam shaft 61 as a result of being pressurized against switching cam 62 by coil spring 65, thus preventing unnecessary movement of cam shaft 61.

The clutch mechanism is formed from clutch member 62*d* of switching cam 62 and clutch member 63*d* of scheduling cam 63. When dial 4 rotates clockwise, thereby rotating scheduling cam 63 counter-clockwise through contact with clip finger 17*c*, the engagement of clutch member 63*d* (on scheduling cam 63) against clutch member 62*d* (on switching cam 62) results in switching cam 62 also rotating counter-clockwise. However, when dial 4 rotates counter-clockwise, thereby rotating scheduling cam 63 in a clockwise direction through contact with clip finger 17*c*, switching cam 62 does not rotate because scheduling cam 63 moves axially upward on cam shaft 61, in a direction against the pressure of coil spring 65, to a point where clutch member 63*d* (on scheduling cam 63) disengages from clutch member 62*d* (on switching cam 62).

Cam switch assembly 60 is constructed so that, regardless of the upward movement of scheduling cam 63 on cam shaft 61 that disengages clutch member 63*d* from clutch member 62*d*, the movement resulting from the counter-clockwise rotation of dial 4 causing clip finger 17*c* to push scheduling cam 63 in the clockwise direction, the outwardly raised position of clip head 17*a* brings clip finger 17*c* into contact with on-cam 63*c*, or the inwardly lowered position of clip head 17*a* does not take clip finger 17*c* out of contact with off-cam 63*b*, and the outwardly raised position of clip head 17*a* locates clip finger 17*c* so as not to not interfere with off-cam 63*b*, or the inwardly lowered position of clip head 17*a* locates clip finger 17*c* so as not to interfere with on-cam 63*c*.

Cam shaft 61 of cam switch assembly 60 is rotatably supported between mid-cover 30 and main case 11 with one end extending upward through and supported by bearing bore 28 in mean case 11. Knob 67 may be attached in any suitable fashion such as, for example, press fitting, gluing, or soldering to the tip of shaft 61 at the end of the shaft extending above bearing bore 28. Cam switch assembly 60 is easily installed to main case 11 due to its modular construction resulting from cam shaft 61 being press fit into switching cam 62, scheduling cam 63 being placed over cam shaft 61, and thrust washer 64 and coil spring 65 being secured on cam shaft 61 by E-clip 66. Cam switch assembly 60 may also be assembled without E-clip 66 through a structure in which switching cam 62 is press fit over cam shaft 61, and scheduling cam 63, thrust washer 64, and coil spring 65 are assembled to cam shaft 61 with spring 65 being compressed and secured in position by direct contact with the inner surface of main case 11 at the time cam switch assembly 60 is installed between main case 11 and mid-cover 30. Moreover, while this embodiment specifies a thrust washer installed between scheduling cam 63 and coil spring 65 in order to reduce friction generated therebetween by the pressure applied by coil spring 65, thrust washer 64 may be omitted if it is determined that the pressure applied by coil spring 65 will not cause excessive friction when scheduling cam 63 rotates. Further, while this embodiment specifies that cam shaft 61 be press fit into switching cam 62 and that scheduling cam 63 rotate freely on cam shaft 61, cam shaft 61 may be press fit into scheduling cam 63 and switching cam 62 may freely rotate on cam shaft 61.

With the previously described switch bracket 53 set to the automatic position, turning knob 67 of cam switch assembly 60 counter-clockwise will result in switching cam 62 rotating together with cam shaft 61, and as shown in FIG. 7*a*, turning knob 67 to an "on" position will result in flange 52*b* of spring arm 52 moving off of the tip of an upper cam 62*b* into the valley between the cams, thus allowing spring arm 52 to be displaced toward spring arm 51 due the tensile energy inherent in spring arm 52. This brings a lower cam 62*c* of switching cam 62 into contact with flange 51*b* of spring arm 51, thus bringing contact points 51*a* and 52*a* into mutual contact as a result of the flexing movement of spring arm 51 toward spring arm 52.

Turning knob 67 in one direction to the "off" position, as shown in FIG. 7*b*, will result in flange 51*b* of spring arm 51 falling off of the cam and into the valley between lower cams 62*c* of switching cam 62, and thus displacing spring arm 51 in a direction away from spring arm 52 as a result of the tensile energy inherent in spring arm 51. At the same time, an upper cam 62*b* of switching cam 62 comes into contact with flange 52*b* of spring arm 52, thus flexing spring arm 52 in a direction away from spring arm 51 to separate contact points 51*a* and 52*a*. Furthermore, turning knob 67 in a direction opposite to the counter-clockwise direction of cam shaft 61, as driven by contact with clip finger 17*c* of scheduling clip 17 on the perimeter of dial 4, will bring flanges 51*b* and 52*b* (of spring arms 51 and 52 which are not in mutual contact) against the ends of lower cam 62*c* and upper cam 62*b* respectively and prevent cam shaft 61 from rotating, thus allowing knob 67 to be turned only in a counter-clockwise direction. Because dial 4 does not turn when knob 67 is manually rotated, clutch member 63*d* ratchets against clutch member 62*d* of switch cam 62, thus preventing the rotation of scheduling cam 63. It is easy to determine the open or closed condition of contact points 5 in relation to the position of knob 67 due to an arrow marking on the end face of knob 67 and "on" and "off" markings provided on the front of main case 11. Furthermore, while this embodiment specifies knob 67 to manually move contact points 5 to "on" and "off" positions, knob 67 may be omitted if a manually controlled "on" and "off" operation is not required.

The following will describe clock mechanism 1 which includes primarily dial 4, sub-dial scale 18, pointer 19, and sub-dial 20.

The dial 4 structure includes dial base 15, dial cover 16, and multiple scheduling clips 17. Dial base 15, which may be formed of any suitable material such as, for example, molded synthetic resin, includes dome-shaped platform 15*a* in which bearing bore 15*b* is formed at the center for the insertion of cylindrical bearing boss 11*b* which extends from the center of recess 11*a* in main case 11. Dial base 15 also includes perimeter lip 15*c* that extends upward from the sidewall of platform 15*a*. Dial cover 16, which may be formed of any suitable material such as, for example, a molded synthetic resin, includes circular plate-shaped perimeter flange 16*a* located at platform 15*a*, perimeter wall 16*b* extending downward from the edge of perimeter flange 16*a*, and lock finger 16*c*, formed on the underside of perimeter flange 16*a*, that locks to orifice 15*d* provided on dial platform 15. Scheduling clip 17, an h-shaped clip that may be formed of any suitable material such as, for example, molded synthetic resin, includes clip head 17*a*, L-shaped clip leg 17*b* that extends downward from clip head 17*a*, and clip finger 17*c* that extends outward beneath clip head 17*a*. Multiple scheduling clips 17 (96 in this embodiment) are placed along the perimeter of dial platform 15, and are able to swing thereon due to the horizontally extending portion of each clip leg 17*b* inserted between dial base 15 and the lower edge of perimeter wall 16*b* of dial cover 16. More particularly, tipping clip head 17*a* of scheduling clip 17 downward (toward the center of dial base 15) results in the tip of clip finger 17*c* moving upward into contact with off-cam 63*b* of scheduling cam 63, and tipping clip head 17*a* upward and outward results in the tip of clip finger 17*c* moving downward into contact with off-cam 63*b* of scheduling cam 63. Moreover, round hole 16*d* is openly formed within perimeter flange 16*a* of dial cover 16 concentric with bearing bore 15*b* in dial base 15, and a 24-hour scale is provided around the perimeter of perimeter flange 16*a*, in relation to clips 17, said scale being marked off in specific time increments such as, for example, fifteen minute increments.

Dial 4 is housed within recess 11 a by placing bearing bore 15*b* of dial base 15 over bearing boss 11*b* of in main case 11, and engaging a lock ridge (not shown in the drawings) formed on the inner perimeter of bearing bore 15*b* to bearing boss 11*b*, thus attaching dial 4 to main case 11 in a way that allows the rotating movement of dial 4 in a clockwise or counter-clockwise direction as viewed from above. Further, gear 40*a* of mushroom gear 40 projects through shaft orifice 11*c*, which is formed in the floor of recess 11*a*, and extends from front surface of main case 11 to mesh with gear 15*e* formed on the rear surface of platform 15*a* of dial base 15. Torque from motor 2 is conveyed to mushroom gear 40 through gearwheel transmission 3, thus dial 4 rotates together with mushroom gear 40.

A circular recess is formed within perimeter flange 16*a* of dial cover 16 within which circular plate-shaped sub-dial scale 18 is fixedly inserted so as not to rotate with respect to case 11. In other words, sub-dial scale 18 does not rotate. Hole 18*a* is formed in the center of sub-dial scale 18, and external gear 18*b* is concentrically formed around hole 18*a*. Moreover, a twelve hour time scale is inscribed on the upper surface of sub-dial scale 18 in specific time increments.

Sub-dial 20 is a dome-shaped member made from any suitable material such as, for example, transparent synthetic resin. Indicator line 21 is formed on the upper surface of sub-dial 20, and orifice 20*a*, a small approximately oval-shaped opening when viewed from above, is formed in the approximate center of the upper surface. By securing orifice 20*a* to tip 24*a* of step shaft 24 (tip 24*a* being formed to a small approximate oval-shape as viewed from above), sub-dial 20 and step shaft 24 become a single structure through which sub-dial 20 rotates in unison with step shaft 24. Step shaft 24 projects upward through orifice 20*a* in sub-dial 20, and lock ring 22 is secured to the tip of step shaft 24 to prevent the detachment of sub-dial 20. Moreover, sub-dial 20 may be press fit or bonded to step shaft 24 and thus eliminate the need for lock ring 22. Also, this embodiment specifies the attachment of decorative cap 23 to the upper surface of sub-dial 20 to visibly cover lock ring 22 and the tip of step shaft 24 at least to improve appearance.

Pointer 19, which is formed by mutually meshed external and internal gears 18*b* and 19*a*, is rotatably supported between sub-dial scale 18 and sub-dial 20. A circular boss (not shown in the drawings) formed on the underside of sub-dial 20 joins to the hole in the center of pointer 19, and due to the circular boss being eccentrically aligned to step shaft 24, pointer 19 orbits (eccentric rotation) around the perimeter of step shaft 24 while rotating itself. Because the number of teeth on outer and inner gears 18*b* and 19*a* are established at a ratio that advances pointer 19 through a one hour time increment (approximately 30 degrees) for each rotation of sub-dial 20, the time scale of sub-dial scale 18, pointer 19, and indicator line 21 combine to form a twelve hour clock able to display the current time.

Figure 6A:
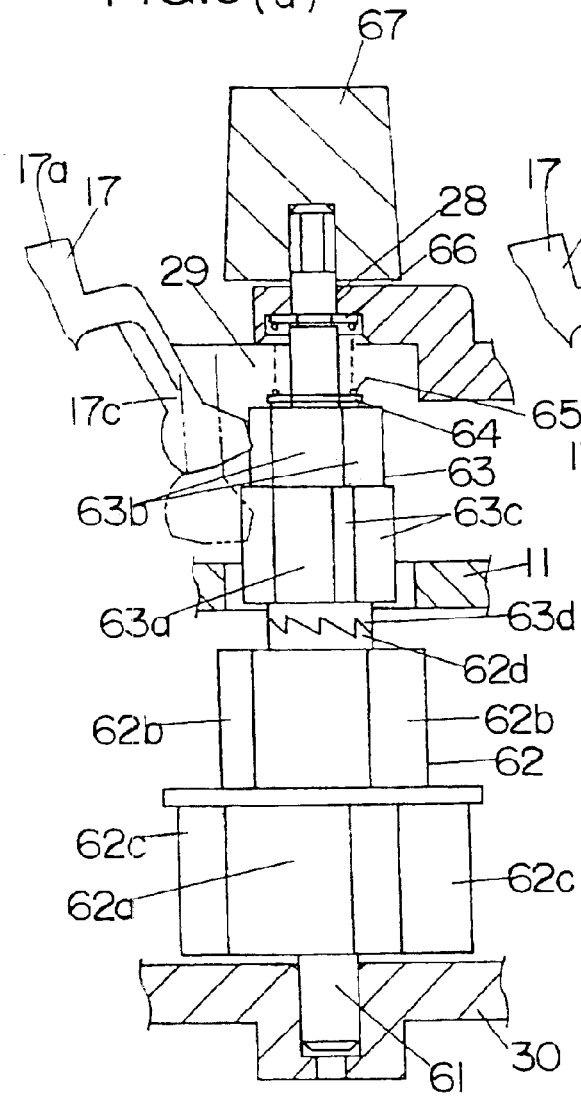
FIG. 6*a* is a cross sectional view switch assembly of the time switch of the embodiment of FIG. 1.

The following will describe operation of the time switch of the present invention. Dial 4 rotates in a clockwise direction at a uniform speed with one or more scheduling clips 17 tipped outward at the desired position corresponding to the time during which the connected electrical load is be operated. As shown in FIG. 6*a*, clip fingers 17*c* extend from the perimeter of dial 4 and are thus able to press against off-cam 63*b* and on-cam 63*c* of scheduling cam 63, which is exposed through open part 29, and thus turn cam shaft 61 in 45 degree increments.

As shown in FIG. 7*b*, with clip head 17*a* raised outward and contact points 51*a* and 52*a* separated, clip finger 17*c* contacts on-cam 63*c* at the lower end of scheduling cam 63 and thus rotatably drives cam shaft 61 through a 45 degree arc. This results in upper cam 62*b* of switching cam 62 separating from flange 52*b* of spring arm 52, and lower cam 62*c* pressing against flange 51*b* of spring arm 51 to flex spring arm 51 toward spring arm 52, a movement that connects contact points 51*a* and 52*b*.

With contact points 51*a* and 52*a* in mutual contact, clip finger 17*c*, as shown in FIG. 7*a*, presses against upper positioned off-cam 63*b* (in this case, clip head 17*a* of scheduling clip 17 is tipped down and inward) which results in cam shaft 61 rotating through a 45 degree arc that allows flange 51*b* on spring arm 51 to fall off of lower cam 62*c* of switching cam 62, thus allowing spring arm 51 to spring back in a direction away from spring arm 51. At the same time, upper cam 62*b* presses against flange 52*b* of spring arm 52, thus causing spring arm 52 to flex away from spring arm 51 and separate contact points 51*a* and 52*a*.

Although scheduling clip 17 operates through the above described mechanism to activate the time at which it is desired to operate the desired electrical load, sub-dial 20 may still be manually rotated in a clockwise or counter-clockwise direction to set the current time.

When sub-dial 20 is manually turned in the clockwise direction (the same direction sub-dial 20 is driven by motor 2), ninth shank gear 41 also attempts to rotate clockwise through its connection to sub-dial 20 through step shaft 24. Because the gears ranging from first shank gear 31 (which is attached to the output shaft of motor 2) to ninth drive gear 39 are in mesh, however, ninth drive gear 39 cannot be manually rotated at a speed greater than that at which it is driven by motor 2. Therefore, pawls 41*a* of ninth shank gear 41 flex and ride over ratchet teeth 39*a* in order to allow ninth shank gear 41 to disconnect from ninth drive gear 39, thus resulting in only mushroom gear 40 rotating counter-clockwise in mesh with pinion gear 41*b* of ninth shank gear 41. The counter-clockwise rotation of mushroom gear 40 drives dial 4 in a clockwise direction, thereby allowing the time to be set by turning sub-dial 20 to the desired time setting. Furthermore, contact points 5 will open and close at this time through the contact of clip fingers 17 with off-cam 63*b* and on-cam 63*c* on scheduling cam 63 as a result of scheduling clips 17 protruding from the perimeter of rotating dial 4.

Figure 8:
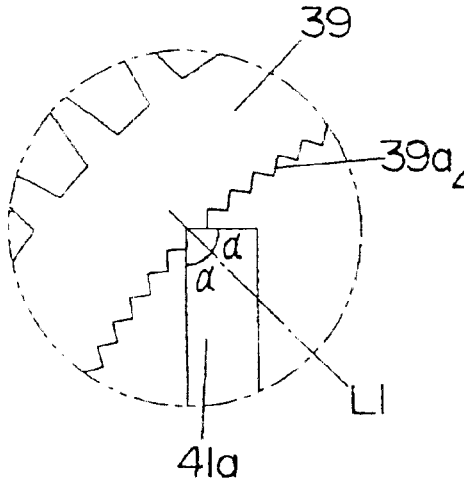
FIG. 8*a* shows the ninth shank gear housed within the ninth gear of the time switch of the embodiment of FIG. 1, as viewed from below.
FIG. 8*b* shows the ninth shank gear housed within the ninth gear of the time switch of the embodiment of FIG. 1 at their point of mutual contact.
Figure 8:
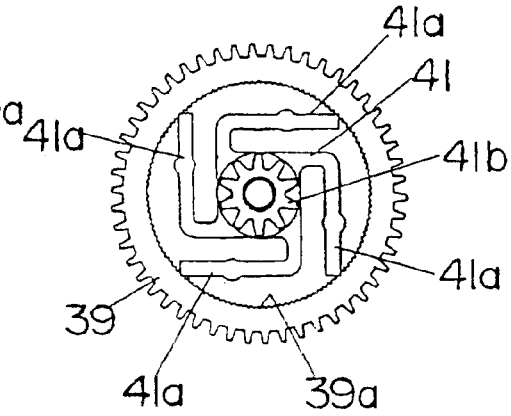

Conversely, if sub-dial 20 is manually turned in a counter-clockwise direction (a direction opposite to that driven by motor 2), ninth shank gear 41 will attempt to turn counter-clockwise due to its connection to sub-dial 20 through step shaft 24, but because first shank gear 31 (which is attached to the output shaft of motor 2) through ninth drive gear 39 are in mesh, and because the rotating direction of fourth gear 34 is restricted by rotational restrictor cam 44, ninth drive gear 39 is prevented from turning in a direction opposite to that of motor 2 due to the tip surfaces of pawls 41*a* pressing against the flanks of ratchet teeth 39*a*. If the torque applied to sub-dial 20 is greater than the torque applied to ninth drive gear 39 from motor 2, and if the torque is strong enough to cause pawls 41*a* to flex and ride over ratchet teeth 39*a*, ninth shank gear 41 will turn counter-clockwise disengaged from pawls 51*a*. In other words, the operation of pawls 41*a* against ratchet teeth 39*a* generates greater resistance when sub-dial 20 is manually turned in a direction opposite to the direction driven by motor 2 than when manually turned in the same direction as driven by motor 2. Moreover, as previously noted, only mushroom gear 40 rotates clockwise in mesh with pinion gear 41*b* on ninth shank gear 41 when dial 4 is turned counter-clockwise, thus allowing the time to be set by manually turning sub-dial 20 to the desired time setting. Furthermore, while clip fingers 17*c*, which project from the perimeter of sub-dial 4, will contact off-cam 63*b* and on-cam 63*c* and thus turn scheduling cam 63 clockwise as sub-dial 4 rotates, switching cam 62 will not rotate due to the disengagement of clutch member 63*d* from clutch member 62*d*, and thus the opening or closing of contact points 5 is prevented. FIG. 8 illustrates four pawls 41*a* shaped in the form of bended spokes. The turning of ninth shank gear 41 in a direction opposite to that driven by motor 2 (clockwise when viewed from below) results in pawls 41*a* contacting the flanks of ratchet teeth 39*a* at a more acute angle, and thus become more resistant to flexing. Therefore, it becomes necessary to carefully establish the tip angles of pawl 41*a*, the flank angles of ratchet teeth 39*a*, and the thickness of pawls 41*a* in order to prevent pawls 41*a* from buckling.

As a result of locating the ratchet mechanism within the power transmission path of gearwheel transmission 3, ninth drive gear 39 (which is driven by motor 2) is able to rotatably drive ninth shank gear 41 and thereby rotate dial 4 and sub-dial 20 when the torque applied against ninth drive gear 39 (on the motor side) by mushroom gear 40 (on the dial side) is not sufficient to cause slipping of the ratchet mechanism. Moreover, in cases where sub-wheel 20 is manually turned in a clockwise or counter-clockwise direction, the rotation of sub-dial 20 and ninth shank gear 41 causes the ratchet mechanism to slip, thus preventing the torque of rotating ninth shank gear 41 from being conveyed to ninth drive gear 39. Therefore, the time can be set by turning sub-dial 20 in either a clockwise or counter-clockwise direction because only dial 4 is rotated. More torque must be applied to turn sub-dial 20 in a direction opposite to that driven by motor 2 as compared to the torque required to turn sub-dial 20 in the same direction as driven by motor 2. Thus, the need to apply increased torque conveys a feeling of increased resistance which makes it easy to determine if the time should be set by advancing sub-dial 20 or turning it back. Furthermore, when sub-dial 20 is turned in a counter-clockwise direction, the disengagement of the clutch mechanism in cam switch assembly 60 allows scheduling cam 63 to turn freely, disconnected from cam switch assembly 60. Because switching cam 62 does not rotate when dial 20 is turned counter-clockwise, pressure is not applied against swing arms 51 and 52 when their operation is not required, thus contact points 5 do not open or close, and the probability of damaging swing arms 51 and 52 is reduced. Moreover, the structure of gearwheel transmission 3 is not limited to that described in this embodiment, but may take the form of any power transmission structure in which a ratchet mechanism is incorporated between motor 2 and sub-dial 20. Furthermore, gearwheel transmission 3 may be structured to drive dial 4 and sub-dial 20 in a counter-clockwise direction.

Figure 9:
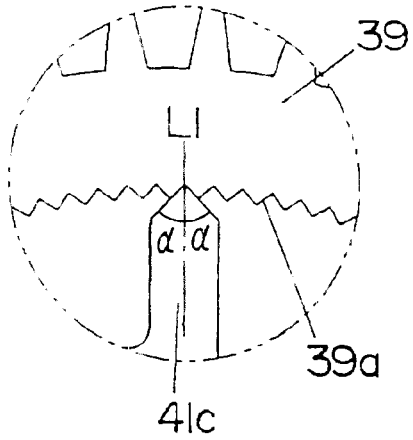
FIG. 9*a* shows a variation of the ninth shank gear housed within the ninth gear of the time switch of the embodiment of FIG. 1, as viewed from below.
FIG. 9*b* shows an exploded view of the ninth shank gear of FIG. 9*a* housed within the ninth gear at their point of mutual contact.
Figure 9:
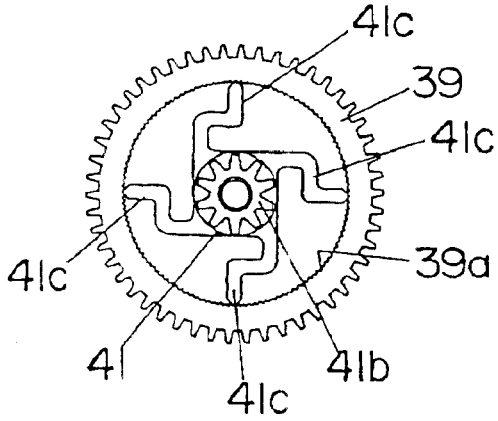
Figure 10:
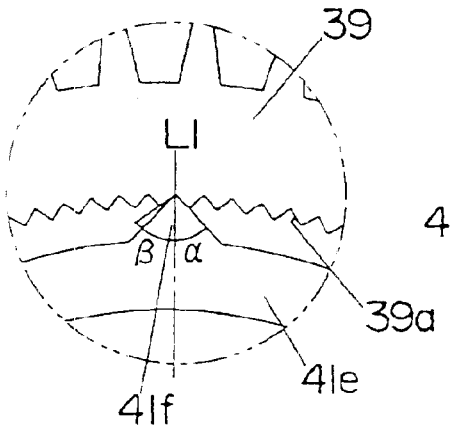
FIG. 10*a* shows a variation of the ninth shank gear housed within the ninth drive gear of the time switch of the embodiment of FIG. 1 as viewed from below.
FIG. 10*b* shows an exploded view of the ninth shank gear of FIG. 10*a* housed within the ninth drive gear of the time switch of the embodiment of FIG. 1 at their point of mutual contact.
Figure 10:
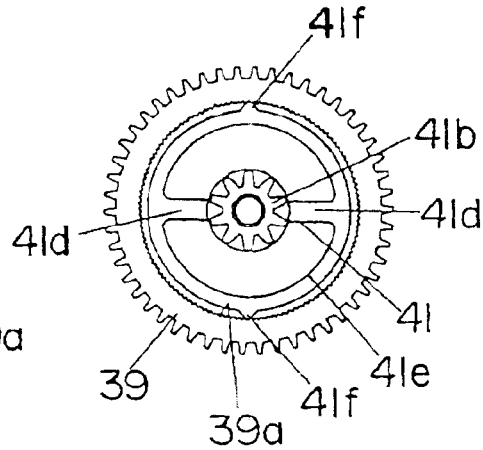

The structure of the ratchet mechanism is not limited to that in which triangular ratchet teeth 39*a* are formed on the inner perimeter of a circular recess on the rear of ninth drive gear 39, four L-shaped pawls 41*a* extending in a bended spoke pattern from ninth shank gear 41, and the tips of rectangular plate-shaped pawls 41*a* contact ratchet teeth 39*a* at approximate angle $\alpha$ (e.g. 45 degrees) with respect to radial intersect line L1 at the base line of ratchet teeth 39*a*. The ratchet mechanism may also be constructed, for example, as illustrated in FIGS. 9*a* and 9*b*. In this configuration, ninth shank gear 41 includes four S-shaped pawls 41*c* that extend at uniform intervals from the perimeter of the shank part, and the triangular-shaped tips of pawls 41*c* contact ratchet teeth 39*a* on a line approximately aligned with the radial intersection at the base line of ratchet teeth 39*a*. While this type of ratchet mechanism operates in a similar manner to the ratchet mechanism shown in FIG. 8, pawls 41*c* are, in the FIG. 9 configuration, able to flex more easily as a result of their contacting ratchet teeth 39*a* in a direction approximately aligned with the radial intersection at the base line of ratchet teeth 39*a*. Further, ratchet teeth 39*a* do not apply pressure in a direction that would tend to buckle pawls 41*c* because the flanks of ratchet teeth 39*a* push against the tips of pawls 41*c* at a 45 degree acute angle. This construction also provides relative freedom in establishing the flank angle of ratchet teeth 49*a*, the end face angle of pawls 41*c*, and the thickness of pawls 41*c*. In this configuration, ratchet teeth 39*a* and pawls 41*c* are also constructed to generate greater resistance when sub-dial 20 is turned in a direction opposite to the direction driven by motor 2 as compared to the direction that sub-dial 20 is driven by motor 2.

FIGS. 10*a* and 10*b* illustrate another type of ratchet mechanism which may incorporate ratchet ring 41*e* which is connected to the shank part of ninth shank gear 41 through spoke parts 41*d*. Triangular pawls 41*f*, which mesh with ratchet teeth 39*a*, are formed on ratchet ring 41*e* at the approximate mid-point between spoke parts 41*d*. In this structure, ratchet teeth 39*a* are asymmetrical in that the flanks of each ratchet tooth are formed differently with respect to line L1 which is the approximate radial intersection with the base line of ratchet teeth 39*a*. The tooth flank to the right of line L1 is inclined at angle $\alpha$ with respect to line L1, and the tooth flank to the left of line L1 is inclined at angle $\beta$ with respect to line L1, and angle $\beta$>angle $\alpha$. Each pawl 41*f* on ratchet ring 41*e*, however, has a symmetrical shape whereby the angles on the left and right sides of line L1, which is the approximate radial intersection with the base line of ratchet teeth 39*a*, are the same.

When sub-dial 20 is manually turned in the clockwise direction (the same direction as driven by motor 2), ninth shank gear 41 attempts to turn clockwise along with sub-dial 20 due to gear 41 being fixedly connected to step shaft 24 to which sub-dial 20 is attached. However, as the gearwheels from first shank gear 31 to ninth drive gear 39 are in mesh, and as ninth drive gear 39 cannot be rotated faster in the same direction than the speed at which it is driven by motor 2, pawls 41*e* ride over ratchet teeth 39*a* due to the flexing of ratchet ring 41*e*, thereby causing ninth shank gear 41 to rotate freely from its disconnection with ninth drive gear 39. This results in only mushroom gear 40, which is meshed to pinion gear 41*b*, rotating in the counter-clockwise direction. Sub-dial 20 can thus be turned to the desired time setting due to the clockwise turning of dial 4 and the counter-clockwise turning of mushroom gear 40.

When sub-dial 20 is manually turned in the counter-clockwise direction (the opposite direction to that driven by motor 2), ninth shank gear 41 attempts to turn counter-clockwise along with sub-dial 20 due to its connection to step shaft 24 to which sub-dial 20 is attached. As previously noted, however, due to ninth drive gear 39 not being able to rotate in a direction opposite to that driven by motor 2, applying a level of torque to sub-dial 20 greater than that applied by motor 2 will result in pawls 41*f* riding over ratchet teeth 39*a* due to the flexing of ratchet wheel 41*e*, thereby resulting in ninth shank gear 41 rotating counter-clockwise disconnected from ninth drive gear 39. Because only mushroom gear 40 turns in the clockwise direction as a result of its meshed connection to pinion gear 41*b* of ninth shank gear 41, and because dial 4 turns in the counter-clockwise direction, sub-dial 20 can be turned to set the desired time. Furthermore, when sub-dial 20 is manually turned, more torque must be applied to turn it in a direction opposite to that driven by motor 2 as compared to that required to turn it in the same direction as driven by motor 2. A feeling of greater resistance is felt when turning sub-dial 20 in the direction opposite to that driven by motor 2, thus making it easy to determine if the time should be set by continuing to advance sub-dial 20 or turning it back in the other direction. Moreover, as shown in FIGS. 10*a* and 10*b*, each pawl 41*f* of ratchet ring 41*e* is symmetrically formed to the left and right sides of line L1, thereby resulting in ratchet ring 41*e* flexing the same amount regardless of the direction that ninth shank gear 41 turns. However, because the right and left flanks of ratchet teeth 39*a* are asymmetrically formed to flank angles $\alpha$ and $\beta$ ($\beta$>a), more torque is required to turn sub-dial 20 in a direction opposite to that driven by motor 2 than in the direction driven by motor 2, thus making it easy to establish the amount of torque that will be required to turn sub-dial 20. Ratchet teeth 39*a* and ratchet ring 41*e* thus form a mechanism able to generate resistance which can be felt when manually turning sub-dial 20.

Figure 6B:
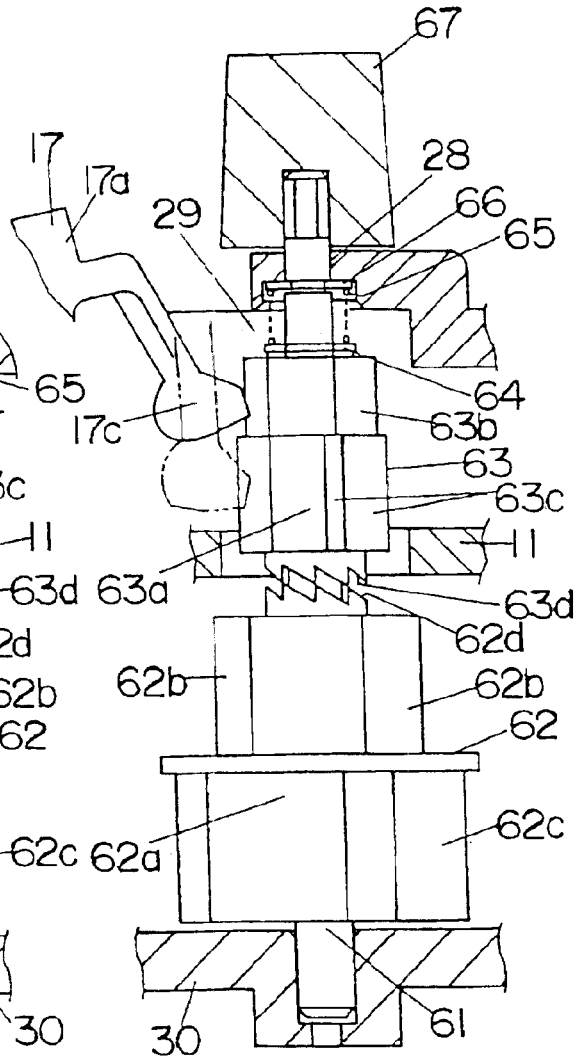
FIG. 6*b* is a cross sectional view of the switch assembly of the time switch of the embodiment of FIG. 1.
Figure 7:
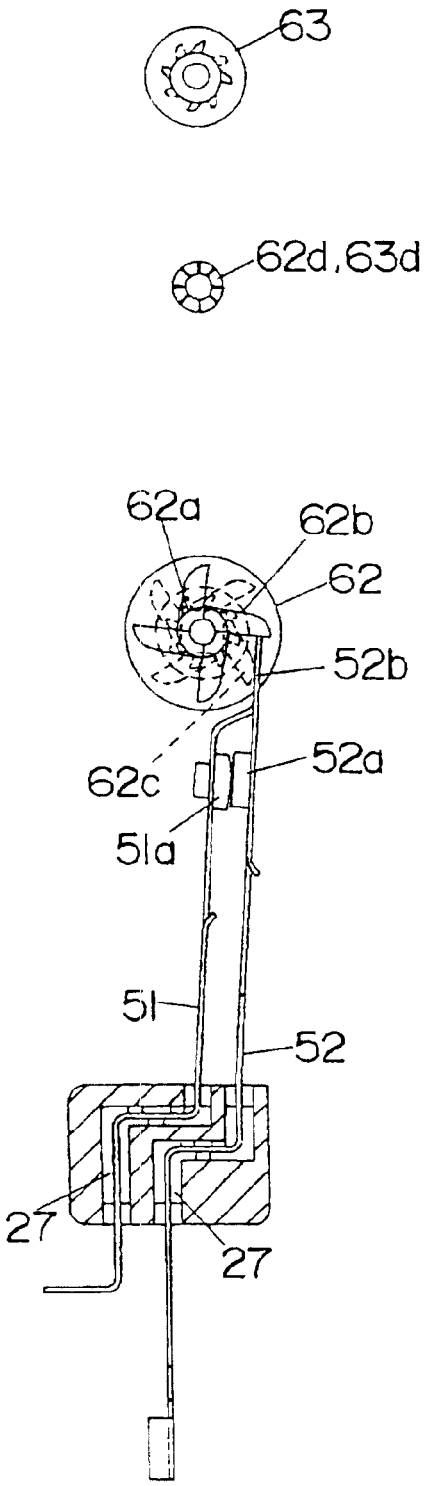
FIG. 7*a* shows the operation of the contact points of the time switch of the embodiment of FIG. 1.
FIG. 7*b* shows the operation of the contact points of the time switch of the embodiment of FIG. 1.
Figure 7:
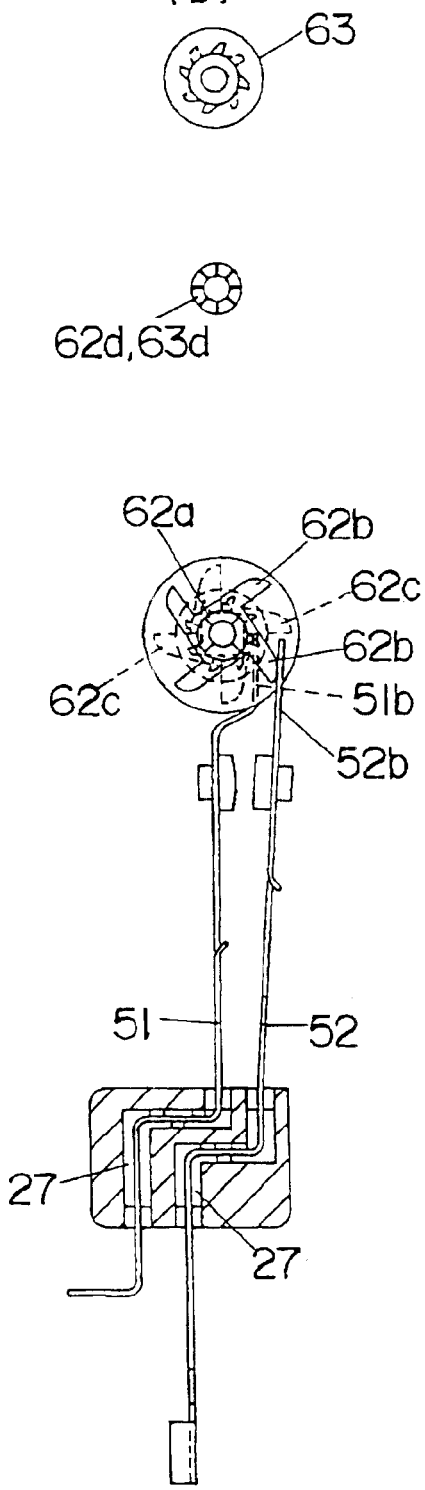

Furthermore, in this embodiment, the number of clutch teeth 62*d* on switching cam 62 and clutch teeth 63*d* on scheduling cam 63 (as shown in FIG. 6) are the same (8 teeth) as the combined number of off-cams 63*b* and on-cams 63*c* as shown in FIGS. 6*a* and 6*b*. As a result of there being eight clutch teeth 62*d* and 63*d*, the manual or motor 2 driven rotation of dial 4 in the clockwise direction, after turning dial 4 manually in the counter-clockwise direction, results in clip finger 17*c* of clip 17, which extends from the perimeter of dial 4, pressing against off-cam 63*b* and on-cam 63*c* to open and close points 5.

In other words, when dial 4 is rotated forward, either manually or by the operation of motor 2, clip finger 17*c* of scheduling clip 17, which extends from the perimeter of dial 4, presses against on-cam 63*c* or off-cam 63*b* of scheduling cam 63 which results in the rotation of scheduling cam 63 and switching cam 62. While contact points 5 open and close from the rotation of upper cam 62*b* or lower cam 62*c* on switching cam 62, because switching cam 62 and scheduling cam 63 are mounted to a single cam shaft 61, the total number of upper cams 62*b* and lower cams 62*c* (8 cams) on switching cam 62 must be the same as the total number of off-cams 63*b* and on-cams 63*c* (eight) of scheduling cam 63. Because this embodiment specifies that there be four off-cams 63*b* and four on-cams 63*c* on scheduling cam 73, cams 63*c* and 63*b* each rotate 45 degrees when struck by clip finger 17*c*. For example, if there were to be three off-cams 63*b* and three on-cams 63*c* on scheduling cam 63, scheduling cam 63 would rotate 60 degrees when an off-cam 63*b* or on-cam 63*c* is struck by clip finger 17*c*. Contact points 5 could not be opened or closed if switching cam 62 were to rotate 60 degrees from the rotation of scheduling cam 63. Therefore, in this embodiment, the total number of upper and lower cams 62*b* and 62*c* on switching cam 62 is established as a whole integer multiple (1-to-1 in this embodiment) of the total number of off-cams 63*b* and on-cams 63*c* of scheduling cam 63 so that switching cam 62 turns to the same rotational angle as scheduling cam 63 to bring contact points 63 in and out of mutual contact. Moreover, switching cam 62 and scheduling cam 63 may have a mutually different number of cams if rotatably supported on separate shafts.

In addition, when dial 4 is manually turned in the counter-clockwise direction, the clutch will slip to allow only scheduling cam 63 to turn in 45 degree increments. However, if the number of clutch teeth 62*d* on switching cam 62 and the number of clutch teeth 63*d* on scheduling cam 63 are established as a whole integer multiple of the total number of off-cams 63*b* and on-cams 63*c* on scheduling cam 63 (a multiple of 1 in this embodiment), clutch teeth 62*d* of switching cam 62 and clutch teeth 63*d* of scheduling cam 63 will interlock when scheduling cam 63 completes its arc of rotation. Therefore, the subsequent manual or powered (by motor 2) rotation of dial 4 in the clockwise direction will result in clip finger 17*c* of scheduling clip 17, which projects from the perimeter of dial 4, pressing against off-cam 63*b* or on-cam 63*c* of scheduling cam 63, and therefore making it possible to quickly rotate switching cam 62.

In other words, with contact points 5 having been switched to their "on" state by an "on" clip finger 17*c*, dial 3 is manually rotated in the counter-clockwise direction (the opposite direction to that driven by motor 2) so that the "on" clip finger 17*c* that switched contact points 5 to their "on" state passes scheduling cam 63, an "off" clip finger 17*c* passes scheduling cam 63, and the next "on" clip finger 17*c* moves up to scheduling cam 63. During this time, scheduling cam 63 rotates approximately 45 degrees from contact with the "on" clip finger 17*c* that switched contact points 1 to their "on" state, and a further approximate 45 degrees from contact with the "off" clip finger 17*c*, thus rotating a total of 90 degrees while contact points 5 have remained in their "on" state, and with an "on" clip finger 17*c* at scheduling cam 63. Because clutch teeth 62*d* of switching cam 62 are engaged with clutch teeth 63*d* of scheduling cam 63, the manual or powered (by motor 2) rotation of dial 4 in the clockwise direction (the direction driven by motor 2) will cause an "off" clip finger 17*c* to press against off-cam 63*b* of scheduling cam 63, thus resulting in scheduling cam 63 and switching cam 62 rotating approximately 45 degrees to switch contact points 5 to their "off" state.

To offer an additional example, with contact points 5 having been switched to their "on" state by an "on" clip finger 17*c*, dial 4 is manually turned in the counter-clockwise direction to the extent that "on" clip finger 17*c*, which has just switched contact points 5 to their "on" state, moves past scheduling cam 63, an "off" clip finger 17*c* moves past scheduling cam 63, the next "on" clip finger 17*c* moves past scheduling cam 63, and the next "off" clip finger 17*c* is brought up to the switching position. During this time, scheduling cam 63 rotates approximately 45 degrees from contact with the clip finger 17*c* that switched contact points 5 to their "on" state, a further approximate 45 degrees from contact with the next "off" clip finger 17*c*, and a further 45 degrees from contact with the next "on" clip finger 17*c*. Scheduling cam 63 has thus rotated a total of approximately 135 degrees with contact points 5 remaining in their "on" state and with an "off" clip finger 17*c* now at the scheduling cam 63 position. If it is determined at this time that an "off" clip finger 17*c* is at scheduling cam 63, and it is desired that contact points 5 be switched to their "off" state, this can be done by manually turning knob 67 which, in this embodiment, allows contact points 5 to be quickly and forcefully opened or closed. After contact points 5 have been switched to their "off" state through the manual turning of knob 67 (as a result of clutch teeth 62*d* of switching cam 62 being engaged to clutch teeth 63*d* of scheduling cam 63) the manual or powered (by motor 2) rotation of dial 4 in the clockwise direction (the direction driven by motor 2) results in an "on" clip finger 17*c* contacting on-cam 63*c* of scheduling cam 63, thus resulting in scheduling cam 63 and switching cam 62 rotating approximately 45 degrees to switch contact points 5 to their "on" state.

The following describes the time setting operation if knob 67 (which allows contact points 5 to be quickly and manually opened or closed) were omitted from the time switch. At a time when contact points 5 have been switched to their "on" state by clip finger 17*c* coming to the switching position, it is not difficult to set the time by manually turning dial 4 counter-clockwise past the desired time setting to the next "on" clip finger 17*c*, and then rotating dial 4 clockwise to the desired time setting. Also, at a time when contact points 5 have been switched to their "off" state by clip finger 17*c*, and dial 4 is manually turned counter-clockwise to set the desired time, it is not difficult to turn dial 5 past the desired time setting to the next "off" clip finger 17*c* switching position, and then turn dial 4 manually clockwise to the desired time setting.

Further, while this embodiment specifies that the respective number of clutch teeth 62*d* and 63*d* on switching cam 62 and scheduling cam 63 be equal, switching cam 62 may be formed with sixteen clutch teeth 62*d*, a number double that of the number of teeth (eight) of off-cam 63*b* and on-cam 63*c* of scheduling cam 63. In this case, even though there are eight clutch teeth 63*d* on scheduling cam 63 (the same number of teeth on off-cam 63*b* and on-cam 63*c*), turning dial 4 manually in the counter-clockwise direction will result in clip finger 17*c*, which projects from the perimeter of dial 4, turning only scheduling cam 63 to a rotational angle (approximately 45 degrees) corresponding to two clutch teeth 63*d* of switching cam 62. When scheduling cam 63 stops turning, clutch teeth 62*d* and 63*d* of switching cam 62 and scheduling cam 63 engage, after which the manual or powered (by motor 2) rotation of dial 4 in the clockwise direction makes it possible for switching cam 62 to rotate simultaneously with scheduling cam 63 at the time scheduling cam 63 begins rotating through contact with finger clip 17*c* which projects from the perimeter of dial 4.

By establishing the total number of clutch teeth 62*d* on switching cam 62 as a whole integer multiple of the total number of clutch teeth 63*d* on scheduling cam 63, the manual or powered (by motor 2) rotation of dial 4 in the clockwise direction, after dial 4 has been manually turned in the counter-clockwise direction, results in the mutual engagement of clutch teeth 62*d* and 63*d* of switching cam 62 and scheduling cam 63, thus making it possible to open or close contact points 5 through the operation of clip finger 17*c* of a scheduling clip 17 positioned at a time setting subsequent to the present time. Moreover, the provision of sixteen clutch teeth 62*d* on switching cam 62, a number twice that of the eight clutch teeth 63*d* on scheduling cam 63 (the same number of clutch teeth as the total number of clutch teeth on off-cam 63*b* and on-cam 63*c*), will provide the same effect as noted previously.

Figure 12:
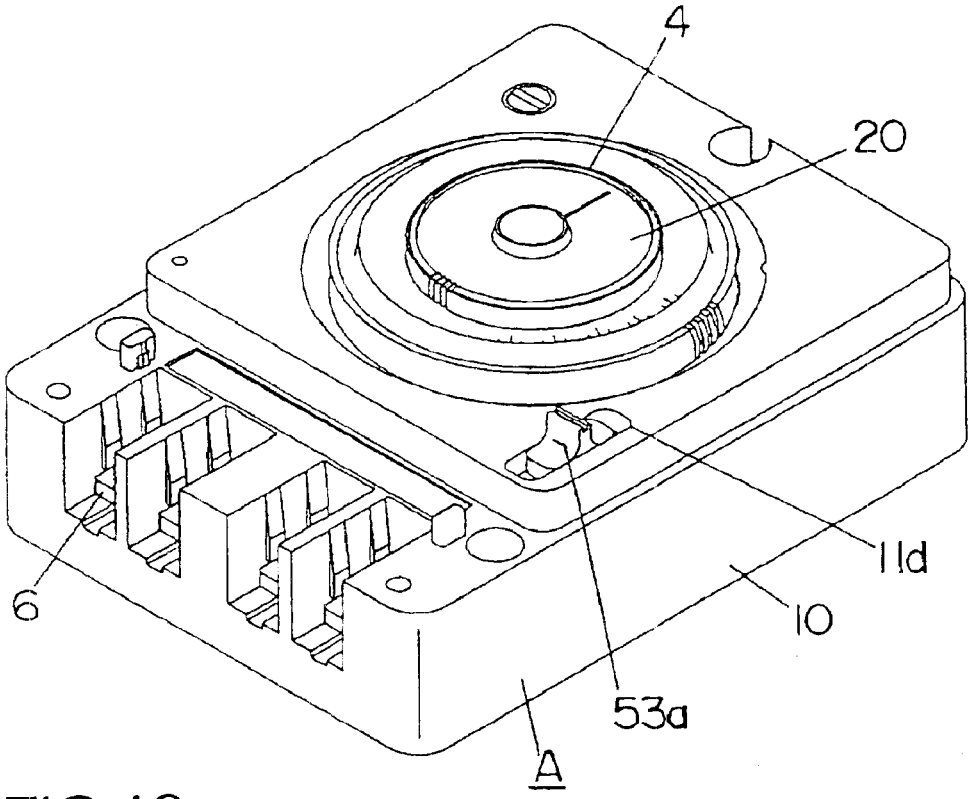
FIG. 12 is an external perspective view of a second embodiment of the time switch of the present invention.
Figure 13:
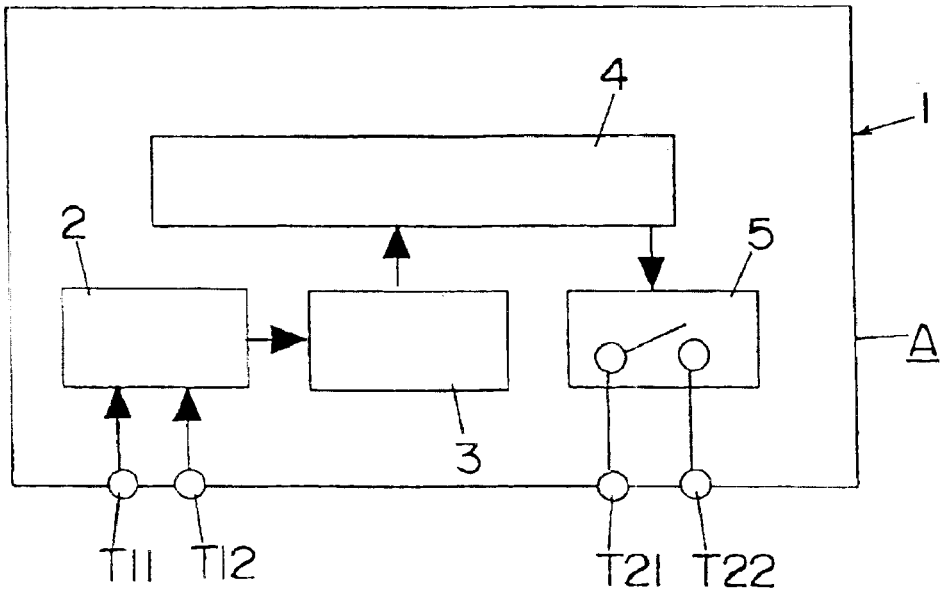
FIG. 13 is a block diagram of the time switch of the embodiment of FIG. 12.

The following will describe a second embodiment of the present invention with reference to FIGS. 12 and 13. The first embodiment specifies knob 67 (through which cam switch assembly 60 can be manually turned) quickly open or close the contact points. This second embodiment, however, eliminates knob 67. Also, while the first embodiment describes time switch 10 as being a single structure separated into main case 11 in which clock mechanism 1 is housed, and sub-case 12 in which the input-output terminal part is housed, the second embodiment houses the clock mechanism and input-output terminal part in the same space, and does not use an external case in which time switch 10 is housed. Moreover, FIG. 13 is a block diagram describing the circuit structure used by the second embodiment in which contact points 5 are connected directly to load terminals T21 and T22 whereby the on-off operation of contact terminals 5 control the on-off operation of the load. Descriptions of structures, operations, and components of the second embodiment that are identical to those of the first embodiment have been omitted.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application Nos. 2003-281235, filed on Jul. 28, 2003, and 2003-301914, filed on Aug. 26, 2003, which are herein expressly incorporated by reference in their entireties.

What is claimed is:

1. A time switch comprising:

a switch case, a dial rotatably attached to the face of said switch case, said dial rotatably driven at a uniform speed through a gearwheel transmission powered by a motor rotating at a uniform speed;

scheduling clips including finger portions which project from the perimeter of said dial to determine a desired operating time;

a cam shaft supported by said switch case;

first cams projecting from the perimeter of a scheduling cam rotatably supported by said cam shaft, said scheduling cam rotatable through contact with respective finger portions of said scheduling clips, second cams projecting from the perimeter of a switching cam rotatably supported by said cam shaft, said switching cam rotatable in one direction together with said scheduling cam;

contact points that switch between on and off positions relating to the rotation of said second cams provided on said switching cam; and a ratchet mechanism provided within said gearwheel mechanism that does not slip when torque transmitted from the motor is sufficient to rotatably drive said dial, and slips when said dial is manually turned while being rotatably driven by torque transmitted from the motor.

2. The time switch according to claim 1, further comprising:

a manually rotatable sub-dial provided within the gearwheel transmission;

wherein said ratchet mechanism is provided between the motor and said sub-dial.

3. The time switch according to claim 1, further comprising:

a mechanism provided to generate greater resistance to rotation of said dial when the dial is manually turned in a direction counter to the direction in which it is turned by the motor.

4. The time switch according to claim 1, the ratchet mechanism comprising:

a disc-shaped member and multiple ratchet teeth formed at uniform intervals along the internal perimeter of a circular depression formed within one side of said disc-shaped member;

a drive gear that rotates in response to rotation of the motor;

a flexible ratchet pawl and a tip portion on said flexible ratchet pawl held in mesh with said ratchet teeth; and a shank gear that conveys torque from said drive gear to said dial;

wherein said shank gear is rotatably driven by said drive gear, through the ratchet mechanism, by torque transmitted from the motor when said dial is rotatably driven by the motor, said torque being insufficient to disengage the ratchet mechanism, and wherein said shank gear disconnects from said drive gear due to the manual rotation of said dial conveying torque sufficient to flex said ratchet pawls to the extent of riding over said ratchet teeth.

5. The time switch according to claim 4, further comprising:

a mechanism provided to generate a feeling of greater resistance when said dial is manually turned in a direction opposite to the motor-driven direction as compared to the feeling when said dial is manually turned in the motor-driven direction, said mechanism comprising:

a ratchet pawl tip symmetrically formed on both sides of the approximate radial intersection line at the inner perimeter of the circular depression; and triangular ratchet teeth having edges intersecting right and left sides of said radial intersecting line at different angles.

6. The time switch according to claim 1, further comprising:

a clutch mechanism, said clutch mechanism comprising:

first clutch teeth formed on the side of said scheduling cam opposing said switching cam;

second clutch teeth formed on said switching cam, said second clutch teeth meshing with said first clutch teeth; and a pressure applying device to apply pressure to said scheduling cam against said switching cam;

wherein said first and second clutch teeth mutually engage to transfer torque from said scheduling cam to said switching cam when said dial is rotatably driven in the motor-driven direction, and wherein said first and second clutch teeth mutually disengage to prevent the transfer of torque from said scheduling cam to said switching cam when said dial is turned in a direction opposite to the motor-driven direction.

7. The time switch according to claim 6, wherein the number of said first and second clutch teeth comprises as a whole integer multiple of the number of said first cams of said scheduling cam.

8. The time switch according to claim 6, said pressure applying device comprising a coil spring;

said scheduling cam is rotatably supported by a cam shaft provided on said switching cam;

said coil spring is positioned over said cam shaft to apply pressure to said scheduling cam against said switching cam; and a locking clip is joined to a groove formed in said cam shaft to support said coil spring between said scheduling cam and said lock ring.

9. The time switch according to claim 8, further comprising a friction reducing member provided between said scheduling cam and said coil spring.

10. The time switch according to claim 4, wherein said shank gear is formed integrally and in one piece with a supporting shaft.

11. The time switch according to claim 8, wherein said cam shaft is formed integrally and in one piece with said switching cam.

* * * * *